US005507226A

United States Patent [19]

Burke et al.

[11] Patent Number: 5,507,226

[45] **Date of Patent: *Apr. 16, 1996**

[54] REMOVABLE NIP SLEEVE

[75] Inventors: David C. Burke, Portsmouth; Michael A. Novick, New Durham, both of N.H.

[73] Assignee: Heidelberger Druckmaschinen AG, Heidelberg, Germany

[ * ] Notice: The term of this patent shall not extend beyond the expiration date of Pat. No. 5,398,604.

[21] Appl. No.: 349,111

[22] Filed: Dec. 2, 1994

Related U.S. Application Data

[63] Continuation of Ser. No. 238,290, May 5, 1994, Pat. No. 5,398,604, which is a continuation of Ser. No. 23,824, Feb. 23, 1993, abandoned.

[51] Int. Cl.[6] ..... B41F 13/54

[52] U.S. Cl. ..... 101/228; 101/375; 492/30; 492/33; 226/190; 29/235

[58] Field of Search ..... 101/216, 219, 101/225, 227, 228, 375, 389.1, 181, 401, 479; 226/782, 183, 184, 185, 186, 187, 188, 190, 191; 492/2, 5, 28, 30, 33, 34, 48–54, 58; 29/235

[56] References Cited

U.S. PATENT DOCUMENTS

| | | | |
|---|---|---|---|
| 1,576,726 | 3/1926 | Davis | 492/51 |
| 2,721,650 | 10/1955 | Cummings, Jr. et al. | 226/181 |
| 3,035,331 | 5/1962 | Wieman | 492/49 |
| 3,083,887 | 4/1963 | Huck | 226/41 |
| 3,196,701 | 7/1965 | Morrow | 492/48 |
| 3,252,163 | 5/1966 | Yedinak et al. | 226/191 |
| 3,282,486 | 11/1966 | De Moss | 226/190 |
| 3,535,760 | 10/1970 | James | 492/53 |
| 3,599,306 | 8/1971 | Brafford | 492/52 |
| 3,691,949 | 9/1972 | Giori et al. | 101/216 |
| 4,015,320 | 4/1977 | Meckel et al. | 495/50 |
| 4,042,743 | 8/1977 | Larson | 101/401.1 |
| 4,119,032 | 10/1978 | Hollis | 101/375 |
| 4,158,429 | 6/1979 | Ohmori | 226/191 |
| 4,284,222 | 8/1981 | Hawk | 226/181 |
| 4,368,328 | 1/1983 | Watanabe | 492/52 |
| 4,726,293 | 2/1988 | Ende | 101/228 |
| 4,792,076 | 12/1988 | Grunder | 226/191 |
| 4,880,501 | 11/1989 | Schiel | 492/52 |
| 4,903,597 | 2/1990 | Hoage et al. | 101/375 |
| 4,961,378 | 10/1990 | Balow et al. | 101/228 |
| 5,062,193 | 11/1991 | Thompson | 29/235 |
| 5,072,500 | 12/1991 | Wagner | 29/235 |
| 5,114,523 | 5/1992 | Ammon et al. | 29/235 |
| 5,215,013 | 6/1993 | Vrotacoe et al. | 101/375 |
| 5,245,923 | 9/1993 | Vrotacoe | 101/375 |
| 5,289,769 | 3/1994 | Lewis | 101/375 |
| 5,323,702 | 6/1994 | Vrotacoe et al. | 101/375 |
| 5,350,623 | 9/1994 | Derrick | 101/375 |
| 5,398,604 | 3/1995 | Burke et al. | 101/216 |

FOREIGN PATENT DOCUMENTS

| | | | |
|---|---|---|---|
| 0133782 | 1/1979 | Germany | 226/175 |
| 3633155 | 4/1988 | Germany | 101/375 |
| 0271349 | 10/1989 | Japan | 226/190 |
| 1457989 | 12/1916 | United Kingdom | 101/375 |

*Primary Examiner*—Eugene H. Eickholt
*Attorney, Agent, or Firm*—Kenyon & Kenyon

[57] ABSTRACT

A web transporting device usable in a rotary printing press or folder, includes a rotatably driven transport roller having a fixed axis and at least one engagable nip roller having an axis substantially parallel to the fixed axis and being engagable with the driven transport roller. The engagable nip roller has a length corresponding to a maximum width of the web processable in the printing press. A removable nip sleeve is provided which is axially mounted on the engagable nip roller. The removable nip sleeve has an least one ring-shaped annular gap disposed axially along its length which allows the web to ripple as it passes through the web transporting device without causing permanent wrinkles or creases to form in the web. A counterbalancing mechanism is also provided which stabilizes the engagable nip roller in a maintenance position as the removable nip sleeve is replaced.

15 Claims, 5 Drawing Sheets

REMOVABLE NIP SLEEVE

This application is a continuation of Ser. No. 08/238,290, filed May 5, 1994 now U.S. Pat. No. 5,398,604 which is a continuation of 08/023,824, filed Feb. 23, 1993 now abandoned.

FIELD OF THE INVENTION

The present invention relates to a device for transporting webs of material in a rotary printing press or folder, and more particularly to a removable nip sleeve mountable on an engagable nip roller.

BACKGROUND OF THE INVENTION

Known web transporting devices comprise a fixed driven transport roller and at least one narrow engagable nip roller. These narrow engagable nip rollers are inconvenient to use in folders. With each new printing job, the width of a ribbon of web material may change. If so, the narrow nip rollers must be realigned so that they contact both edges of the ribbons. This involves loosening bolts that are used to clamp the nip rollers onto a shaft and sliding nip collars to which each nip roller is attached to the correct position, and then retightening the bolts. This is time consuming and involves considerable machine down-time.

Furthermore, since the nip rollers do not need to operate at a high compressive force, any vibratory impacts between them will tend to separate the nip rollers from the fixed driven transport roller. This leads to ribbon tension variations. In the past, the nip actuation force was increased but the nip rollers' nip force was not because a mechanical stop device was incorporated to determine the roller-to-roller gap. The setting of the mechanical stop is inconvenient and time consuming and must usually be done for each new printing job.

Several attempts have been made to correct these problems. British Patent No. 1,457,989 and U.S. Pat. No. 3,083,887 disclose web transporting devices which are directed to controlling the tension of the web material as it passes through the web transport device.

British Patent No. 1,457,989 discloses a carrier mounted in supports which is moved by two cylinders which are supplied with a pressure medium via a common pressure-medium connection. The force of the pressure is selectable via a control. The mutual connection of the individual chambers of the cylinders effects a displacement of fluid volume from chamber to chamber as a result of volume variations, the position of a lever mounted on one side being thereby stabilized, and the web tension being accordingly held constant.

U.S. Pat. No. 3,083,887 discloses a device having a cylinder subjected to a pressure medium which deflects a lever mounted on one side, in order thereby to increase and decrease, respectively, the belt tension of a drive via a roller.

A disadvantage of these solutions is that they do not provide a sensitively variable or meterable engagement of the rollers due to the long lever arms. On the other hand, due to the use of conventional shock-absorbers and the use of a compound chamber system, respectively, the damping characteristic is severely restricted or limited.

A further disadvantage of these solutions is that they create too much tension on the web material causing it to wrinkle.

One solution to these problems has been to provide an actuation means for applying a variable force of engagement of a engagable full width nip roller with a fixed driven transport roller. Such a device draws essentially wrinkle-free webs which may be formed of several web layers under constant web tension through a folder. This permits the formation of an exact longitudinal fold in the nip between the engagable full width nip roller and the transporting roller. A damping means acting in parallel with the actuating means on the full width nip roller stabilizes the position of the engagable transport roller and prevents or limits a build-up of vibrations.

Although this solution solves many of the above-mentioned problems in the prior art devices, it has a few drawbacks. When nip rollers of this type become damaged or worn, the whole nip roller must be removed. Because the nip roller is full width it is cumbersome and heavy, thus making removal a difficult and time consuming task. Also, when nip rollers of this type become worn they must be rebuilt which involves considerable machine down time.

OBJECTS AND SUMMARY OF THE INVENTION

It is an object of the present invention to provide for the convenient use and maintenance of a seamless full width nip roller.

It is another object of the present invention to provide a web transporting device which eliminates the need to rebuild worn full width nip rollers.

It is a further object of the present invention to provide for a gapless, seamless nip roller, which minimizes runout and increases strength of the transport surface due to its continuity.

It is another object of the present invention to provide a web transporting device which is usable in a folder and capable of drawing wrinkle-free webs formed of at least one layer of material through the folder which may form a correct longitudinal fold.

The present invention provides a web transporting device, comprising: a rotatably driven transport roller having a fixed axis; at least one engagable nip roller having an axis substantially parallel to the fixed axis and being engagable with the driven transport roller, the engagable nip roller having a length corresponding to a maximum width of the web processable in the printing press; and a removable nip sleeve mounted on the engagable nip roller.

An advantage of the present invention is that with this device when the nip sleeve becomes worn or damaged it can be removed and replaced with a new one. This eliminates the need to rebuild worn or damaged nip rollers.

Another advantage of the present invention is that it is convenient to use and allows for easy nip sleeve change. Also, a gapless seamless nip sleeve minimizes runout and strengthens the transport surface.

The present invention also provides a removable nip sleeve that has a compressible layer of material. This compressible surface aids in shock absorption capabilities and improves tension consistency.

The present invention also provides a removable nip sleeve that has at least one ring-shaped annular gap disposed axially along its length. The ring-shaped annular gap is advantageous in that it allows the web material to ripple without causing permanent wrinkles or creases to form.

The present invention also provides a means for counterbalancing the engagable nip roller while in a maintenance position during replacement of the removable nip sleeve. This has the advantage of enabling the removable nip sleeve to be axially slid off of or onto one side of the engagable nip roller without having to completely remove the engagable nip roller from the printing press.

Other objects, characteristics and advantages of the present invention will become apparent in view of the description and accompanying drawings that follow.

DETAILED DESCRIPTION

Figure 1:
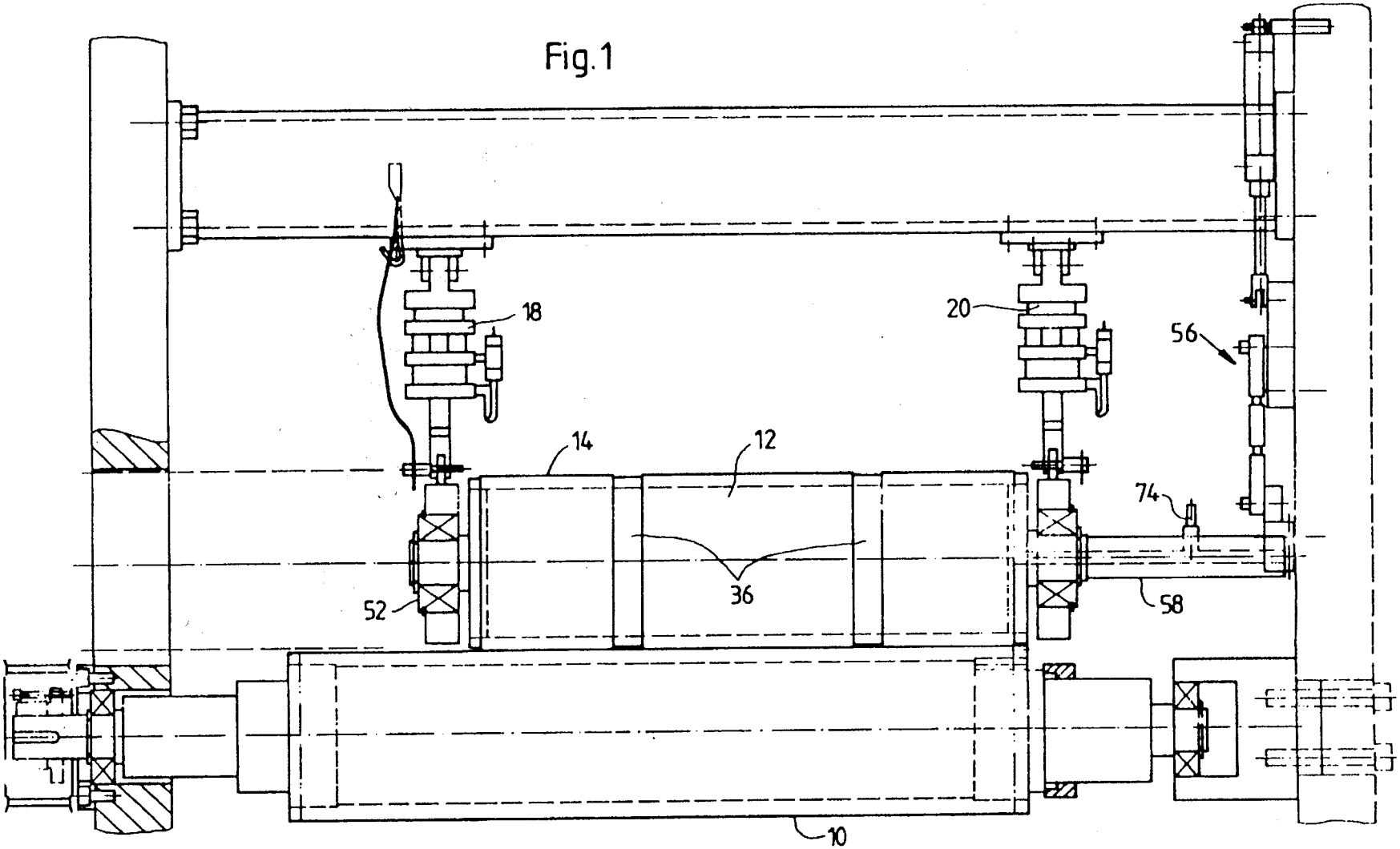
FIG. 1 is top elevational view of a web transporting device according to the present invention.

A web transporting device of the present invention is shown in FIG. 1. The web transport device comprises a rotatably driven transport roller 10 supported in bearings fixed to a frame of a printing press or folder. Opposite the driven transport roller 10, an engagable nip roller 12, having a removable nip sleeve 14 mounted thereon, is disposed so as to be brought into contact with the driven transport roller 10. The engagable nip roller 12 is of full width length, meaning that it has a length which corresponds to the maximum width of a web material processable in the printing press. A web material 16 (shown in FIG. 2) formed of at least one ribbon of material is disposed between the driven transport roller 10 and the engagable nip roller 12.

The engagable nip roller 12 is engaged by arms 18 and 20. The arms 18 and 20 include an actuating device 22, having a control 24 associated therewith, and with a damping element 26 having a throttle 28 connected thereto, as shown schematically in FIG. 2. A sensitively metered actuating or engaging force is afforded by the actuating device 22, while a build-up of vibrations is hindered by the damping element 26 which may be connected either in parallel or in series with the actuating device 22. Presenting of the actuating device 22 can be effected by the control 24, whereas a change in the damping characteristic of the damping element 26 can be effected by the throttle 28.

The nip sleeve 14 has a hollow tubular construction. It is fixedly connected with the engagable nip roller 12 and rotates with the engagable nip roller under the influence of the driven transport roller 10. However, the nip sleeve 14 can be removed from the engagable nip roller 12 and replaced, as will be discussed below.

Figure 2:
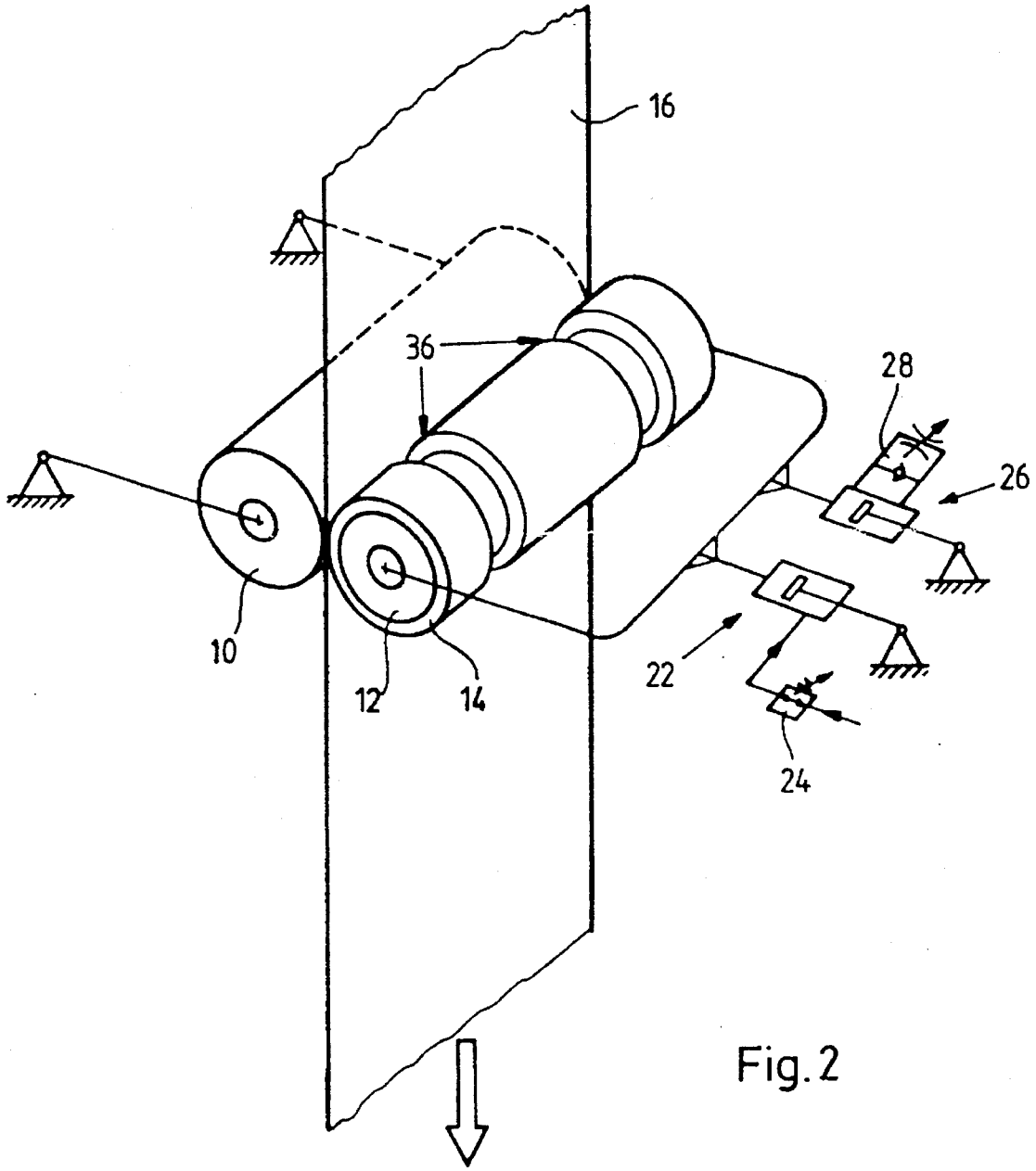
FIG. 2 is a diagrammatic perspective and schematic view of the web transporting device shown in FIG. 1.
Figure 3:
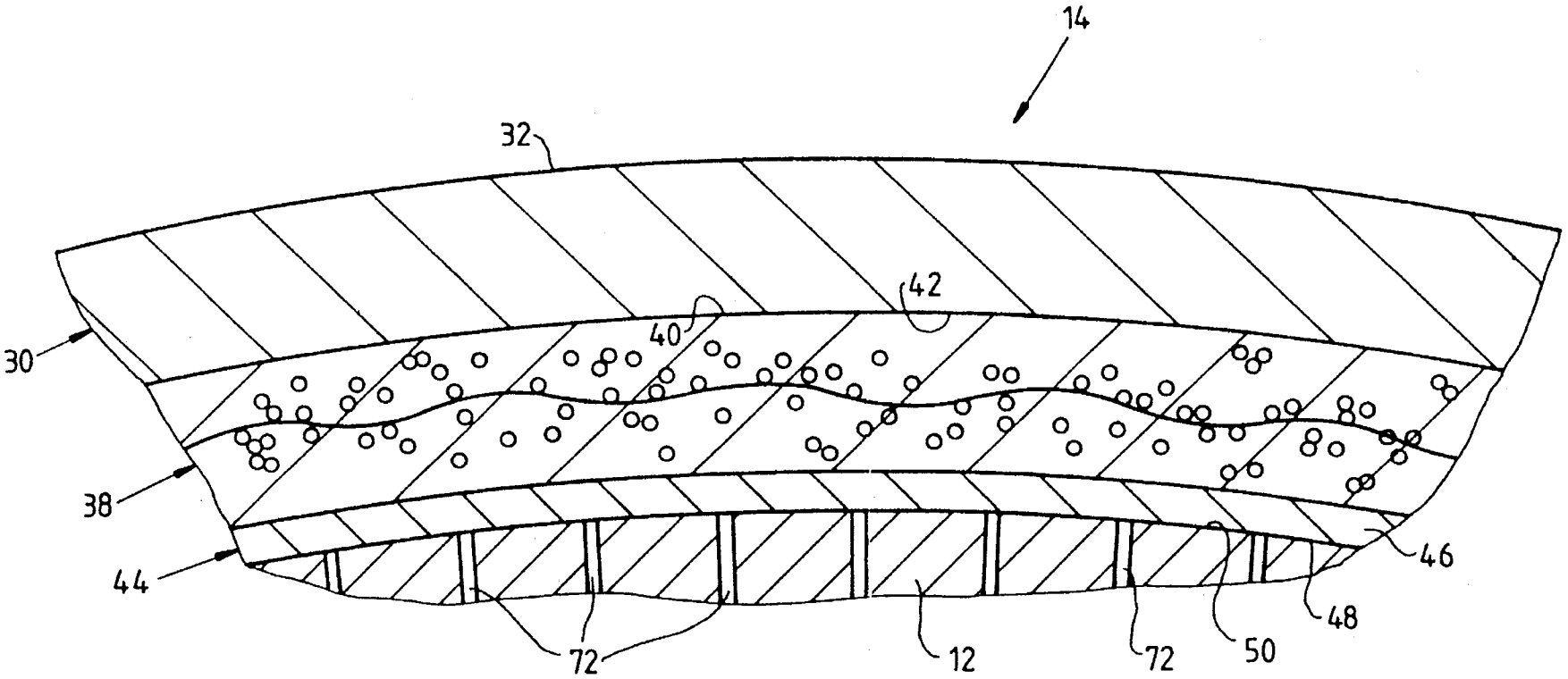
FIG. 3 is an enlarged fragmentary sectional view of a portion of a removable nip sleeve mounted on an engagable nip roller constructed in accordance with the present invention.

Although the nip sleeve 14 could have many different constructions, in the specific embodiment of the present invention illustrated herein, the nip sleeve has a laminated construction. Thus, the nip sleeve 14 includes a cylindrical outer layer 30 upon which a smooth continuous outer side surface 32 of the sleeve is disposed, as shown in FIG. 3. The cylindrical outer layer 30 is preferably formed of a very thin incompressible material of medium hardness, such as natural or artificial rubber. The smooth outer side surface 32 of the nip sleeve 14 has no gaps or seams other than one or more ring-shaped annular gaps 36 disposed axially along the length of the nip sleeve, as shown in FIGS. 1 and 2. The surface 32 assures a definite application or engagement of the engagable nip roller 12 with the web material 16. This surface 32 also markedly increases the precision with which the fold is executed. The ring-shaped annular gaps 36 allow the web material 16 to ripple without forming permanent wrinkles or creases. Both the quantity and widths of the ring-shaped annular gaps may vary depending upon the width and thickness of the ribbons of the web material passing through the wed transporting device.

An intermediate cylindrical layer 38 is disposed radially inwardly of the outer layer 30, as shown in FIG. 3. The intermediate layer 38 has a cylindrical outer side surface 40 which is fixedly secured to a cylindrical inner side surface 42 of the outer layer 30. In one preferred embodiment, the cylindrical intermediate layer 38 is formed of a reinforced resiliently volume compressible material, e.g., at least one layer of a cotton cord material treated with a polymeric foam material. Having a volume compressible layer of material allows the nip sleeve 14 to absorb any shocks that may be occur as the web material passes through the web transporting device.

The intermediate layer 38 is fixedly secured to a hollow elastically expandable rigid metal (or plastic) inner layer 44 comprising a thin-wall tube 46 which is fixedly connected to the engagable nip roller 12. A cylindrical inner side surface 48 of the tube 46 engages a cylindrical outer side surface 50 of the engagable nip roller 12. The tube 46 is releasably fixedly connected with the engagable nip roller 12 to enable the entire nip sleeve 14 to be slid axially onto and/or off of the engagable nip roller. This construction enables the nip sleeve to be replaced after a period of use.

Although the nip sleeve 14 has been described herein as having an inner layer 44 an outer layer 30 and an intermediate layer 38, the nip sleeve could have a greater or lesser number of layers if desired. For example, it could have an additional layer formed of the same material as the outer layer 30 which is disposed radially inwardly of the intermediate layer 38 and radially outwardly of the inner layer 44.

The nip sleeve 14 and the engagable nip roller 12 have a metal-to-metal or (plastic-to-metal) interference fit between the cylindrical metal (or plastic) tube 46 on the inside of the nip sleeve 14 and the outer circumference of the metal engagable nip roller 12. Thus, the inner side surface 48 of the cylindrical tube 46 has a uniform diameter which is slightly less than the uniform diameter of the cylindrical outer side surface 50 of the engagable nip roller 12. The extent of interference required between the tube 46 and engagable nip roller 12 must be sufficient to enable the nip sleeve 14 to firmly grip the engagable nip roller's outer circumference during operation of the printing press or folder so that the nip sleeve does not slip relative to the engagable nip roller.

The tube 46 is stressed in tension by the engagable nip roller 12 to provide a tight pressure relationship between the nip sleeve 14 and the engagable nip roller. This pressure relationship fixes the nip sleeve 14 on the engagable nip roller 12 so that there is no relative movement therebetween during operation of the printing press or folder. The printing press or folder includes means for effecting radial expansion of the tube 46 while on the engagable nip roller 12 to relieve the pressure relationship between the nip sleeve 14 and the engagable nip roller, as will be described hereinbelow. When the pressure relationship is relieved, the nip sleeve 14 may be manually moved axially off of the engagable nip roller 12. Also, the tube 46 must be expanded radially or tensioned radially outwardly in order to move the nip sleeve 14 onto the engagable nip roller 12. The printing press or folder is provided with means for performing this function, as will be discussed below.

Figure 4:
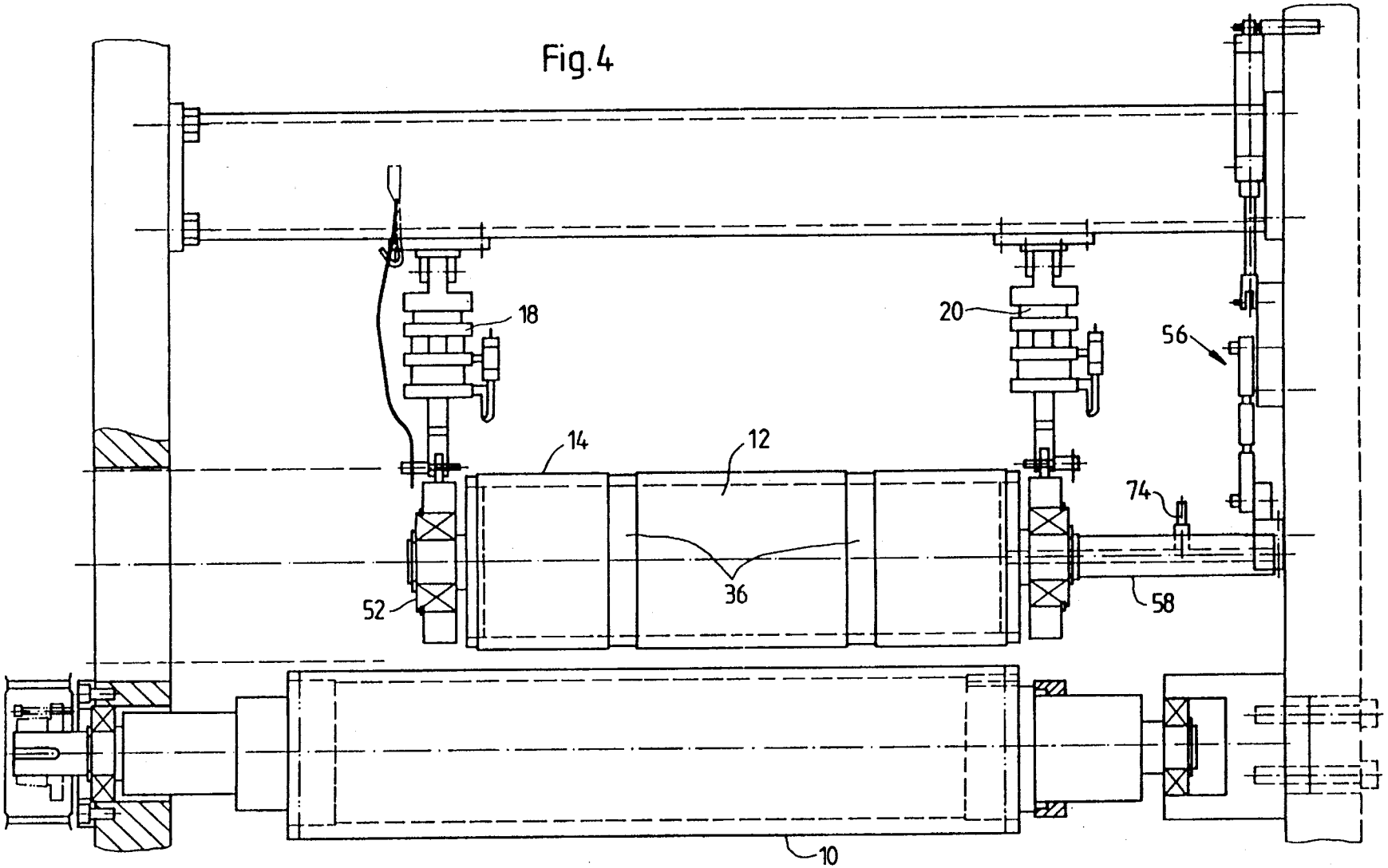
FIG. 4 is a top elevational view of the web transporting device according to the present invention shown in a maintenance position.

When it is desired to remove the nip sleeve 14 from the engagable nip roller 12 and replace it with another nip sleeve, the actuation device 22 moves the engagable nip roller 12 into a maintenance position, as shown in FIG. 4. Once in this position, the nip sleeve 14 can be axially slid off of the engagable nip roller 12 and replaced with a new nip sleeve which can then be axially slid onto the engagable nip roller.

Figure 5:
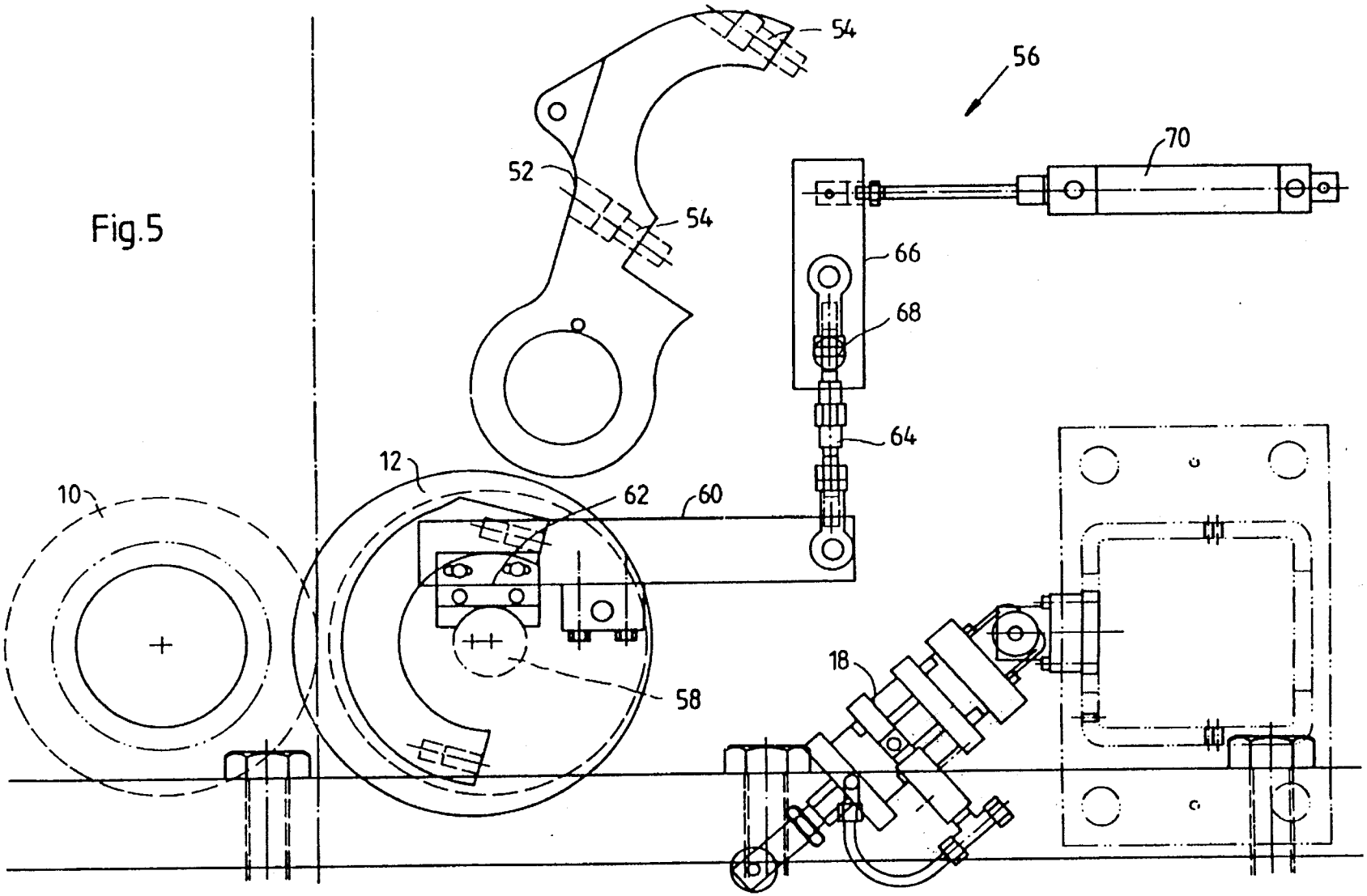
FIG. 5 is a side view of the web transporting device in the maintenance position showing a bearing support of the engagable nip roller removed and a counterbalancing mechanism according to the present invention locked in place to allow for the removal and replacement of a removable nip sleeve according to the present invention.

Before the nip sleeve 14 can be removed from the engagable nip roller 12, a bearing support 52 must be removed. This is accomplished by removing two bolts 54 and rotating the bearing support 52 out of the way, as shown in FIG. 5. Prior to rotating the bearing support 52 out of the way, the arm 18 must be disconnected from the bearing support 52. Once in the rotated away position, the bearing support 52 is held fixed by a releasable spring pin mounted in a collar (not shown).

Once the bearing support 52 is removed, there is no means of supporting the engagable nip roller 12 on the side of the printing press or folder that the bearing support 52 is located on. To prevent the engagable nip roller 12 from dropping to the bottom of the printing press or folder, the present invention provides a counterbalancing mechanism 56. The counterbalancing mechanism 56 is preferably located on the end of the engagable nip roller 12 opposite the bearing support 52 and functions to hold a cylinder journal 58 of the engagable nip roller fixed in place, as shown in FIG. 5.

The counterbalancing mechanism 56 includes a link arm 60 which is attached to a caliper-shaped member 62 on one end and a lifting member 64 on the other. The caliper-shaped member 62 is designed to fit over the cylinder journal 58 in a locking position. The lifting member 64 is in turn connected to a pivot member 66 which pivots about a fixed point 68 on the printing press or folder. The pivot member 66 is in turn connected to an actuating means 70 which my be an air cylinder, pneumatic cylinder, hydraulic cylinder, or similar device. The actuation means 70, via the pivot member 66 and the lifting member 64, operates to move the link arm 60 until the caliper-shaped member 62 is secured onto the cylinder journal 58. In doing so, the actuation means 70 throws the pivot member 66 into an over-toggle position which locks the counterbalancing mechanism 56 into position preventing the engagable nip roller 12 from dropping to the bottom of the printing press or folder.

Once the counterbalancing mechanism 56 is in place and the bearing support 52 is rotated away, the nip sleeve 14 can then be removed.

An alternative method of removing the nip sleeve 14 from the engagable nip roller 12 would be to completely remove the engagable nip roller from the printing press or folder using a crane and then replace the nip sleeve at a location away from the press. Although this is an acceptable method of changing the nip sleeve, the above-mentioned method is preferable because it does not require removing the heavy engagable nip roller and involves less machine down-time.

In order to manually slide the nip sleeve 14 off of the engagable nip roller 12, the nip sleeve must be resiliently expanded by fluid pressure. Thus, the engagable nip roller 12 is provided with radially extending passages 72, as shown FIG. 3. The radially extending passages 72 are spaced apart in a large number of radial places which extend through the engagable nip roller 12 along its length.

The engagable nip roller 12 is hollow and is connected with a source of fluid (air) under pressure by a conduit 74, as shown in FIGS. 1 and 4. The air pressure conducted through the conduit 74 to the interior of the engagable nip roller 12 flows outwardly through the passages 72 and presses against the inner side surface 48 of the tube 46. The air pressure causes the tube 46 to resiliently expand circumferentially an amount sufficient to enable the nip sleeve 14 to be manually slid off of the engagable nip roller 12 with a minimum of difficulty.

This same method is used to manually slide a new nip sleeve 14 onto the engagable nip roller 12. Once a new nip sleeve 14 has been positioned axially onto the engagable nip roller 12, the interior of the engagable nip roller is vented to the atmosphere. The tube 46 of the new nip sleeve 14 then contracts to securely grip the outer side surface 50 of the engagable nip roller 12. The tube 46 is then maintained in tension by the engagable nip roller 12. The magnitude of the air pressure required to effect the necessary resilient expansion of the tube 46 may vary as a function of the radial thickness of the tube, the material from which the tube is made and the extent of interference between the tube and the engagable nip roller 12.

Although the invention is illustrated and described herein as embodied in a web transporting device in rotary printing presses, it is nevertheless not intended to be limited to the details shown, since various modifications and structural changes may be made therein without departing from the spirit of the invention and within the scope and range of equivalents of the claims.

I claim:

1. A web transporting device, comprising:

a rotatably driven transport roller having a fixed axis;

at least one engageable nip roller having an axis substantially parallel to the fixed axis and being engageable with the driven transport roller, the engageable nip roller having a length corresponding to a maximum width of the web processable in a printing press; and a removable nip sleeve fixedly mounted on the engageable nip roller which rotates with the engageable nip roller under the influence of the rotatably driven transport roller, the removable nip sleeve having at least one ring-shaped annular gap disposed axially along its length to allow the web to ripple without forming permanent wrinkles or creases.

2. The web transporting device according to claim 1, wherein the removable nip sleeve comprises at least one layer of material.

3. The wed transporting device according to claim 1, wherein the removable nip sleeve comprises:

a cylindrical outer layer upon which a smooth continuous outer side surface of the sleeve is disposed;

a cylindrical intermediate layer disposed radially inwardly of the outer layer, the intermediate layer having a cylindrical outer side surface which is fixedly secured to a cylindrical inner side surface of the outer layer; and a cylindrical tubular-shaped inner layer, wherein a cylindrical inner side surface of the inner layer engages a cylindrical outer side surface of the engagable nip roller.

4. The web transporting device according to claim 3, wherein the cylindrical outer layer of the removable nip sleeve is formed of a very thin incompressible material of medium hardness.

5. The web transporting device according to claim 3, wherein the intermediate layer of the removable nip sleeve is formed of a resiliently volume compressible material.

6. The web transporting device according to claim 3, wherein the inner layer of the removable nip sleeve is formed of an elastically expandable rigid material.

7. The web transporting device according to claim 3, wherein the removable nip sleeve further comprises an additional layer formed of a very thin incompressible material of medium hardness which is disposed radially inwardly of the intermediate layer and radially outwardly of the inner layer.

8. The web transporting device according to claim 1, wherein the engagable nip roller has at least one radially extending passage which supplies pressurized fluid to resiliently expand the removable nip sleeve during replacement.

9. The web transporting device according to claim 8, wherein the engagable nip roller has a hollow interior which is connected to a source of pressurized fluid by a conduit which conducts the pressurized fluid to the interior of the engagable nip roller and outwardly through the radially extending passage.

10. A web transporting device, comprising:

a rotatably driven transport roller having a fixed axis;

at least one engageable nip roller having an axis substantially parallel to the fixed axis and being engageable with the driven transport roller, the engageable nip roller having a length corresponding to a maximum width of the web processable in a printing press; and a removable nip sleeve mounted on the engageable nip roller, the removable nip sleeve including:

a cylindrical outer layer upon which a smooth continuous outer side surface of the sleeve is disposed;

a cylindrical intermediate layer disposed radially inwardly of the outer layer, the intermediate layer having a cylindrical outer side surface which is fixedly secured to a cylindrical inner side surface of the outer layer;

a cylindrical tubular-shaped inner layer, wherein a cylindrical inner side surface of the inner layer engages a cylindrical outer side surface of the engagable nip roller; and an additional layer formed of a very thin incompressible material of medium hardness which is disposed radially inwardly of the intermediate layer and radially outwardly of the inner layer.

11. A web transporting device, comprising:

a rotatably driven transport roller having a fixed axis;

at least one engageable nip roller having an axis substantially parallel to the fixed axis and being engageable with the driven transport roller, the engageable nip roller having a length corresponding to a maximum width of the web processable in a printing press;

a removable nip sleeve mounted on the engageable nip roller;

a counterbalancing mechanism for counterbalancing the engagable nip roller as the removable nip sleeve is axially slid off of or onto one side of the engagable nip roller during replacement of the removable nip sleeve, the counterbalancing mechanism including:

a link arm attached to a caliper-shaped member on one end and a lifting member on the other, the lifting member in turn being connected to a pivot member which pivots about a fixed point, the pivot member in turn being connected to an actuating device which activates the counterbalancing mechanism throwing the pivot member into an over-toggle position.

12. The web transporting device according to claim 11, wherein the caliper-shaped member is designed to fit over a cylinder journal of the engagable nip roller so as to hold the engagable nip roller in a locked position.

13. The web transporting device according to claim 12, wherein the actuating device moves the link arm until the caliper-shaped member is securely positioned onto the cylinder journal.

14. The web transporting device according to claim 13, wherein the engagable nip roller has at least one radially extending passage which supplies pressurized fluid to resiliently expand the removable nip sleeve during replacement.

15. The web transporting device according to claim 14, wherein the engagable nip roller has a hollow interior which is connected to a source of pressurized fluid by a conduit which conducts the pressurized fluid to the interior of the engagable nip roller and outwardly through the radially extending passage.

* * * * *